US008283564B2

(12) United States Patent
James et al.

(10) Patent No.: US 8,283,564 B2
(45) Date of Patent: Oct. 9, 2012

(54) TERMINATION TOOL WITH CORRESPONDING MALE AND FEMALE CONNECTORS

(75) Inventors: Jason James, Brackmills (GB); Stuart Ponting, Brackmills (GB)

(73) Assignee: Hellermanntyton Data Ltd., Brackmills, Northampton (GB)

( * ) Notice: Subject to any disclaimer, the term of this patent is extended or adjusted under 35 U.S.C. 154(b) by 225 days.

(21) Appl. No.: 12/872,789

(22) Filed: Aug. 31, 2010

(65) Prior Publication Data

US 2010/0319963 A1 Dec. 23, 2010

Related U.S. Application Data

(63) Continuation of application No. PCT/GB2009/000520, filed on Feb. 25, 2009.

(51) Int. Cl.
*H01R 4/24* (2006.01)

(52) U.S. Cl. ..... 174/135; 173/20; 81/54; 439/447

(58) Field of Classification Search ..... 174/135; 173/20, 171, 217; 81/52, 54; 324/67, 671; 439/447, 577, 660, 374
See application file for complete search history.

(56) References Cited

U.S. PATENT DOCUMENTS

| | | | | |
|---|---|---|---|---|
| 7,066,278 | B2 * | 6/2006 | Shotey | 173/20 |
| 7,261,586 | B2 * | 8/2007 | Cramer | 439/447 |
| 7,318,485 | B2 * | 1/2008 | Greese et al. | 173/1 |
| 7,337,697 | B2 * | 3/2008 | Bader et al. | 81/54 |
| 7,594,548 | B1 * | 9/2009 | Puzio et al. | 173/20 |
| 8,035,955 | B2 * | 10/2011 | Parks et al. | 361/679.01 |
| 2004/0137784 | A1 | 7/2004 | Martin | |
| 2004/0244190 | A1 | 12/2004 | Karasch | |
| 2005/0251991 | A1 | 11/2005 | Alexander et al. | |
| 2006/0230608 | A1 | 10/2006 | Caveney et al. | |

FOREIGN PATENT DOCUMENTS

DE 20 2007 017142 2/2008

OTHER PUBLICATIONS

International Search Report PCT/GB2009/000520.

* cited by examiner

*Primary Examiner* — Dhirubhai R Patel
(74) *Attorney, Agent, or Firm* — Brinks Hofer Gilson & Lione

(57) ABSTRACT

A termination tool for terminating multiple wires to a two part electrical connector assembly composed of a wire arrangement manifold and a jack housing is provided by the present disclosure. The termination tool includes a main tool body having a termination housing provided thereon including a first cavity, a second cavity and a passage extending between the first and second cavities. The first cavity has an open side to receive and is shaped to removably retain a wire arrangement manifold, the second cavity having an open side to receive and being shaped to removably retain a jack housing, and the passage being sized to allow, in use, the wire arrangement manifold to pass therethrough from the first cavity to the second cavity and having cutting means provided on opposing sides of its end proximate to the first cavity.

31 Claims, 12 Drawing Sheets

TERMINATION TOOL WITH CORRESPONDING MALE AND FEMALE CONNECTORS

CROSS-REFERENCE TO RELATED APPLICATIONS

This application is a continuation of International Application No. PCT/GB2009/000520 filed on Feb. 25, 2009, which claims the benefit of GB 0804043.8, filed Mar. 4, 2008. The disclosures of the above applications are incorporated herein by reference.

FIELD

The present disclosure relates to a termination tool and corresponding male and female connectors.

BACKGROUND

The statements in this section merely provide background information related to the present disclosure and may not constitute prior art.

Termination tools exist in many different forms, with the desirable characteristics including portability, ease of assembly, ease of use and reliable termination of the connector to communication wires.

US Patent Publication No. 2006/0230608 describes a termination tool for use with network jack plugs and sockets such as CAT 5e, CAT 6, etc. The tool is designed to work in two distinct stages. An electrical connector wire arrangement manifold is prepared by inserting wires into the relevant connector slots on said wire arrangement manifold and placing the cap into a cavity on one side of the tool. Adjacent to said cavity are cutting means, mounted such that upon actuation of a trigger mechanism the cutting means are urged astride the prepared wire arrangement manifold, severing any excess wires protruding thereon and driving the wires securely into the connector slots. A second, separate cavity is provided on the other side of the tool into which the trimmed wire arrangement manifold and a jack housing are inserted adjacent each other. Actuation of the trigger mechanism urges a ram against the wire arrangement manifold, pressing it into engagement with the jack housing, whereupon the wires in the wire arrangement manifold make electrical contact with connection terminals in the jack housing, thus securing the wire arrangement manifold within the jack housing, and terminating wire arrangement manifold and housing sections of the electrical connector.

However, this device suffers from the disadvantage of requiring two distinct operations to be performed; the trimming of wires protruding from the prepared wire arrangement manifold and then the repositioning of said wire arrangement manifold such that a ram may be used to urge the wire arrangement manifold into engagement with a jack housing.

SUMMARY

According to the present disclosure there is provided a termination tool for terminating multiple wires to a two part electrical connector assembly composed of a wire arrangement manifold and a jack housing, the termination tool comprising a main tool body having a termination housing provided thereon including a first cavity, a second cavity and a passage extending between the first and second cavities, the first cavity having an open side to receive and being shaped to removably retain the wire arrangement manifold, the second cavity having an open side to receive and being shaped to removably retain the jack housing, and the passage being sized to allow, in use, the wire arrangement manifold pass therethrough from the first cavity to the second cavity and having cutting means provided on opposing side of its end proximate to the first cavity, the termination tool further comprising a ram aligned with the passage and actuatable to move between a retracted position in which the ram is withdrawn from the first cavity and a second position in which the ram extends through the passage so as, in use, to press the wire arrangement manifold from the first cavity, through the passage and into engagement with the jack housing located in the second cavity, the cutting means severing any overhanging wire tails from the sides of the wire arrangement manifold as it enters the passage.

A termination tool is thus provided where corresponding male and female connectors are arranged such that in one motion the tool is used to cut multiple electrical connector wires and then terminate wire arrangement manifold and housing sections of an electrical connector. A termination tool in accordance with the present disclosure has the advantage that the whole termination operation is performed in a single operation, increasing efficiency.

In one form, the first cavity is of complementary shape to and a close tolerance fit with the wire arrangement manifold such that, in use, the wire arrangement manifold is constrained against lateral movement in the first cavity. Similarly, the second cavity is of complementary shape to and a close tolerance fit with the jack housing such that, in use, the jack housing is constrained against lateral movement in the second cavity. In this way, the wire arrangement manifold and jack housing are accurately aligned with each other so as to ensure reliable termination upon actuation of the tool.

In one form, the first cavity includes a groove in each side surface thereof adjacent the cutting means at the mouth of the passage in which, in use, tails of wires inserted into the wire arrangement manifold are received so as to align them for trimming by the cutting means upon operation of the tool. This has the further advantage that the longitudinally asymmetric configuration of the grooves prevents insertion of the wire arrangement manifold into the first cavity in the wrong orientation since the wire tails will then not align with the grooves and hence the close tolerance fit of the wire arrangement manifold in the first cavity will prevent entry of the wire arrangement manifold into the first cavity.

The cutting means, in one form, comprises a pair of blades, one on either side of the mouth of the passage. Further advantageously, the position of the cutting means is related to the thickness and spacing of wires in the wire arrangement manifold, such that, in use, the leading edge of the cutting means engages with, and subsequently severs, the wire tails sequentially, rather than simultaneously. This has the advantage of reducing the force required to operate the tool and therefore, for example, reducing a required actuator pivot length or the like. The sequential severing of the wire tails could be achieved by offsetting the cutting means either side of the mouth of the passage relative to each other, by inclining the cutting edge of the cutting means relative to the direction of movement of the wire arrangement manifold or by a combination of the two. Preferably the wire tails are severed in pairs and further advantageously the cutting means is positioned such that the severance of a pair of wire tails by the cutting means is completed before the next pair of wire tails is subsequently engaged by the leading edge of the cutting means. The width of the passage is also advantageously equal in width to the first cavity.

The passage may include a longitudinally extending rib on the top of each side, which reduces the width of the passage at the top and thereby prevents the wire arrangement manifold from being removed from the passage during operation of the tool.

In one form, the second cavity includes one of a projection and a recess in a side thereof, in particular the side opposite the passage, and the jack housing includes a complementary other of a projection and a recess which aligns with the one of the projection and the recess when the jack housing is correctly oriented with respect to the second housing. This has the advantage that it ensures proper alignment of the jack housing upon insertion since it will be prevented from entering the second cavity if wrongly oriented. In a preferred embodiment, the jack housing includes a tab, which engages in a slot, which extends from the open side of the second cavity.

The open sides of the first and second cavities are on the same side of the tool in one form of the present disclosure.

The depth of the first cavity is preferably such that when the wire arrangement manifold is fully inserted therein, it aligns with the passage. Similarly, the depth of the second cavity is preferably such that, when the jack housing is fully inserted therein, an opening in the jack housing in which the wire arrangement manifold engages for effecting termination is aligned with and facing the passage.

In one form, the tool is hand operated, including trigger which is connected to the ram so as to effect longitudinal movement of the ram from its retracted position to its extended position. A ratchet mechanism is advantageously integrated with the trigger mechanism, which operates to prevent retraction of the ram, once operative movement has commenced, until the ram has reached its fully extended position. This has the advantage that it ensures that proper termination occurs between the wire arrangement manifold and the jack housing. Other means may also be provided which prevents operation of the trigger until a wire arrangement manifold has been properly inserted into the first cavity and a jack housing has been properly inserted into the second cavity.

The trigger may be spring-loaded to effect return of the ram to its retracted position once the termination stroke has been completed.

The present disclosure further provides a wire arrangement manifold for use with a termination tool according to the disclosure, comprising a body having an end surface with an opening therein through which, in use, a cable formed of a plurality of separate wires is insertable, a front face having a plurality of notches formed therein proximate to at least one side of the wire arrangement manifold, each notch size to retain one of the wires of the cable therein, and a passage extending from the opening in the end surface to the front face for channelling the wires to the notches.

In one form, the notches in the front face of the wire arrangement manifold are arranged in two rows, one extending along each side of the body, with the notches being equispaced along the body. In particular, the end housing has eight notches arranged in two rows of four.

The body in one form is rectangular in shape, at least when viewed in the direction of the front face. The opening in the end face is preferably open to the back of the end housing, the passage taking the form of a through opening which extends from the back to the front face of the body.

The present disclosure still further provides a jack housing for matingly engaging with the wire arrangement manifold of the disclosure, the jack housing comprising a body having a socket formed in a front end therein containing a plurality of contacts, an opening in a top side of the body and a plurality of termination jaws upstanding from the bottom of the opening, each termination jaw being electrically connected to an associated one of the contacts, the opening being of complementary size and shape to the wire arrangement manifold such that, in use, the wire arrangement manifold is insertable into the opening from the top thereof such that each wire located in one of the notches in the wire arrangement manifold engages between one of termination jaws, effecting electrical contact therewith.

In one form, the back wall of the opening in the jack housing has a slot formed therein extending from the top edge, the cable extending from the wire arrangement manifold, in use, being received in the slot as the wire arrangement manifold engages in the opening.

The bottom of the body advantageously has a guide tab thereon of narrower width than the main body, which, in use, aligns with and engages in a complementary shaped recess formed in the second cavity when the jack housing is correctly oriented with respect to the second cavity and prevents entry of the jack housing into the second cavity in the wrong orientation. The guide tab is advantageously formed as a mounted hook for latching the jack housing in place in a patch panel, wall mounting or the like.

In one form, the opening includes eight termination jaws arranged in two rows of four to complement the arrangement of the notches in the wire arrangement manifold, each jaw being composed of a pair of metal prongs with a space between them which narrows towards the base of the opening such that as a wire is pressed therebetween, the jaws progressively cut through the insulation on the wire and make electrical contact with the core of the wire.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
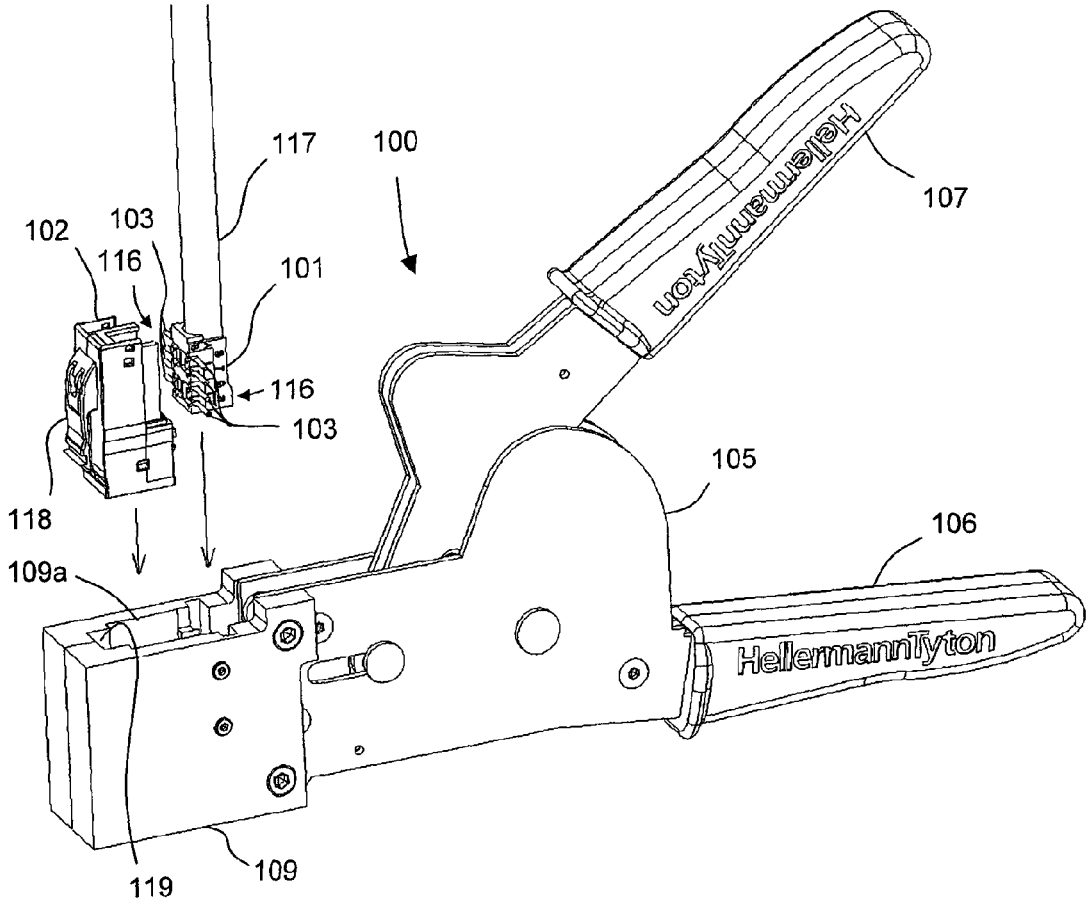
FIG. 1 is a side view of an apparatus according to the invention, showing the insertion of a jack housing and wire arrangement manifold.
Figure 4A:
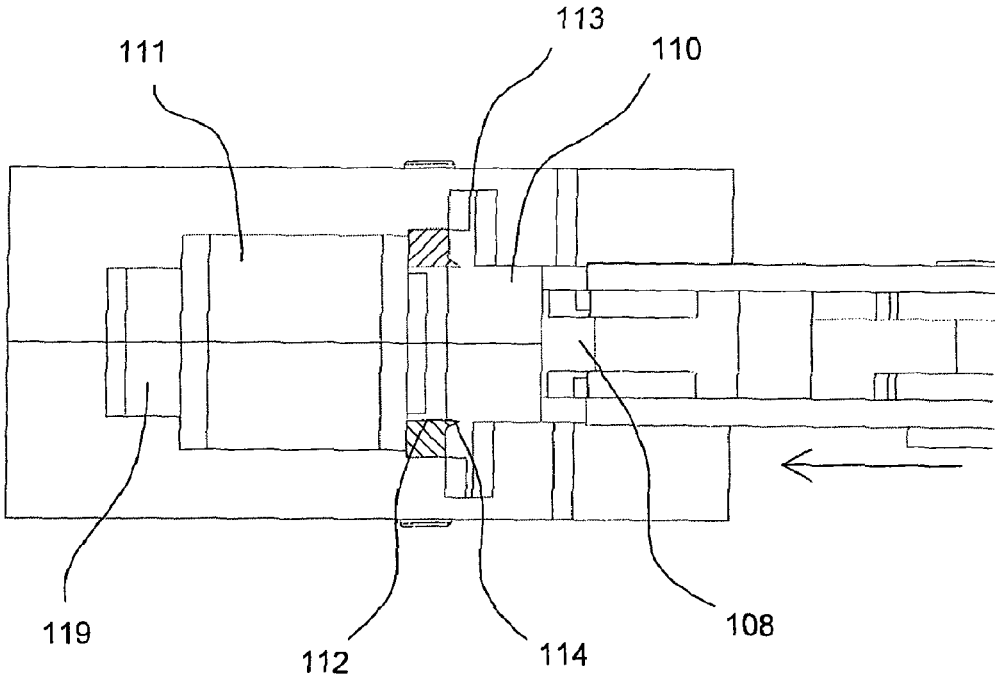
Figure 5:
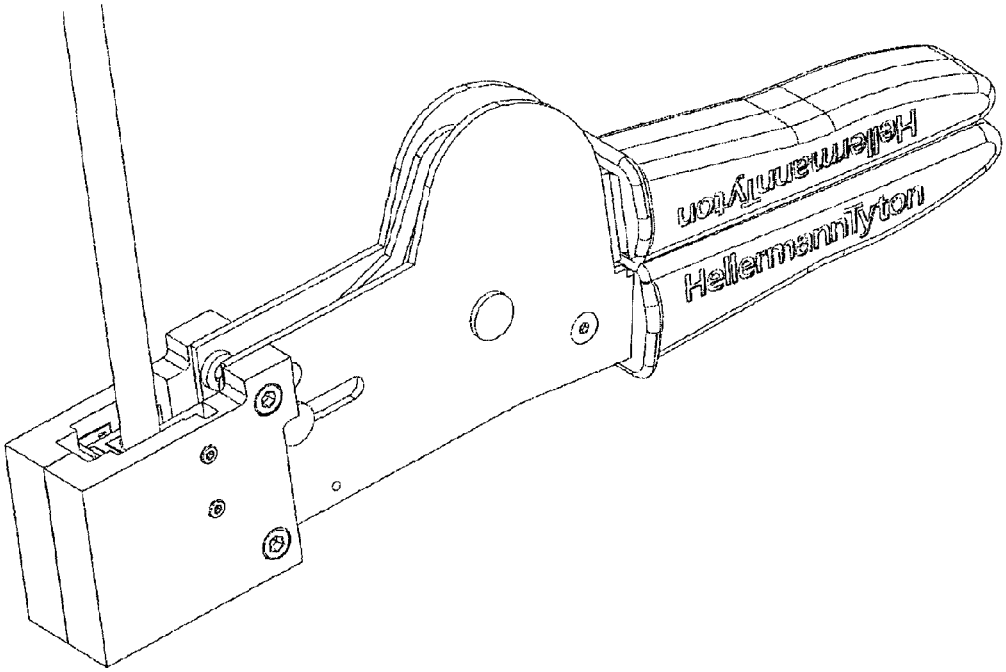
Figure 6:
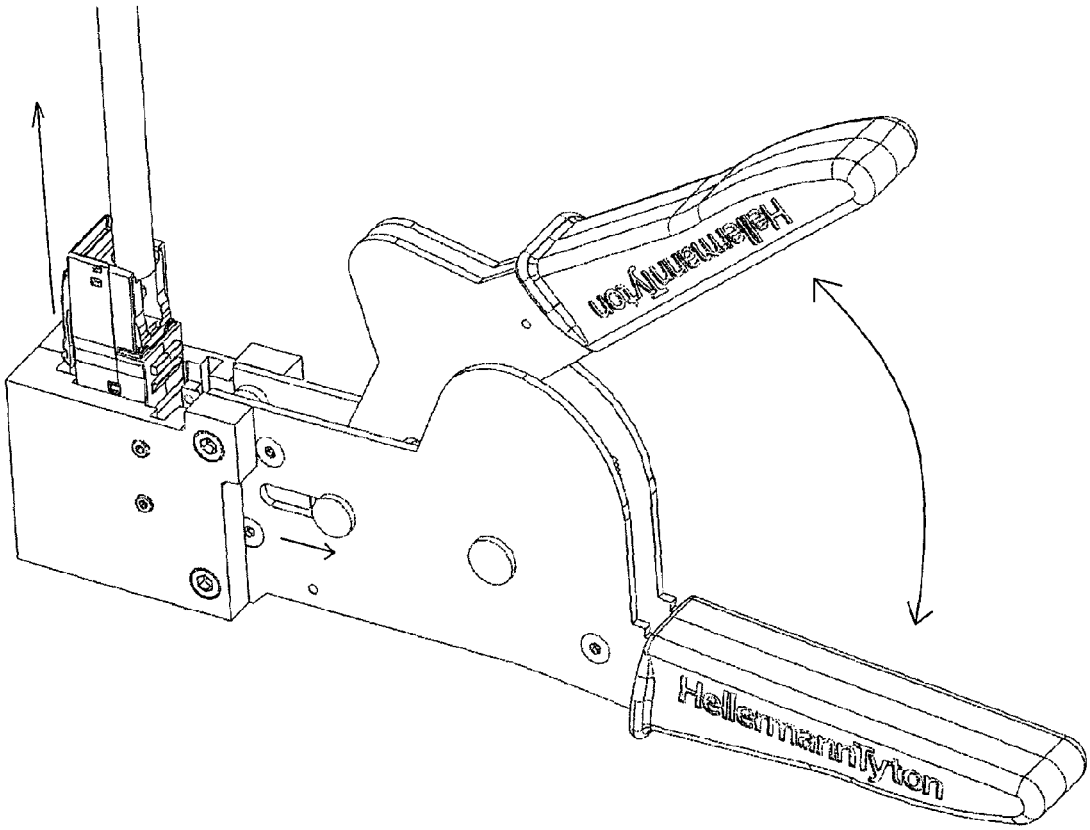
Figure 7:
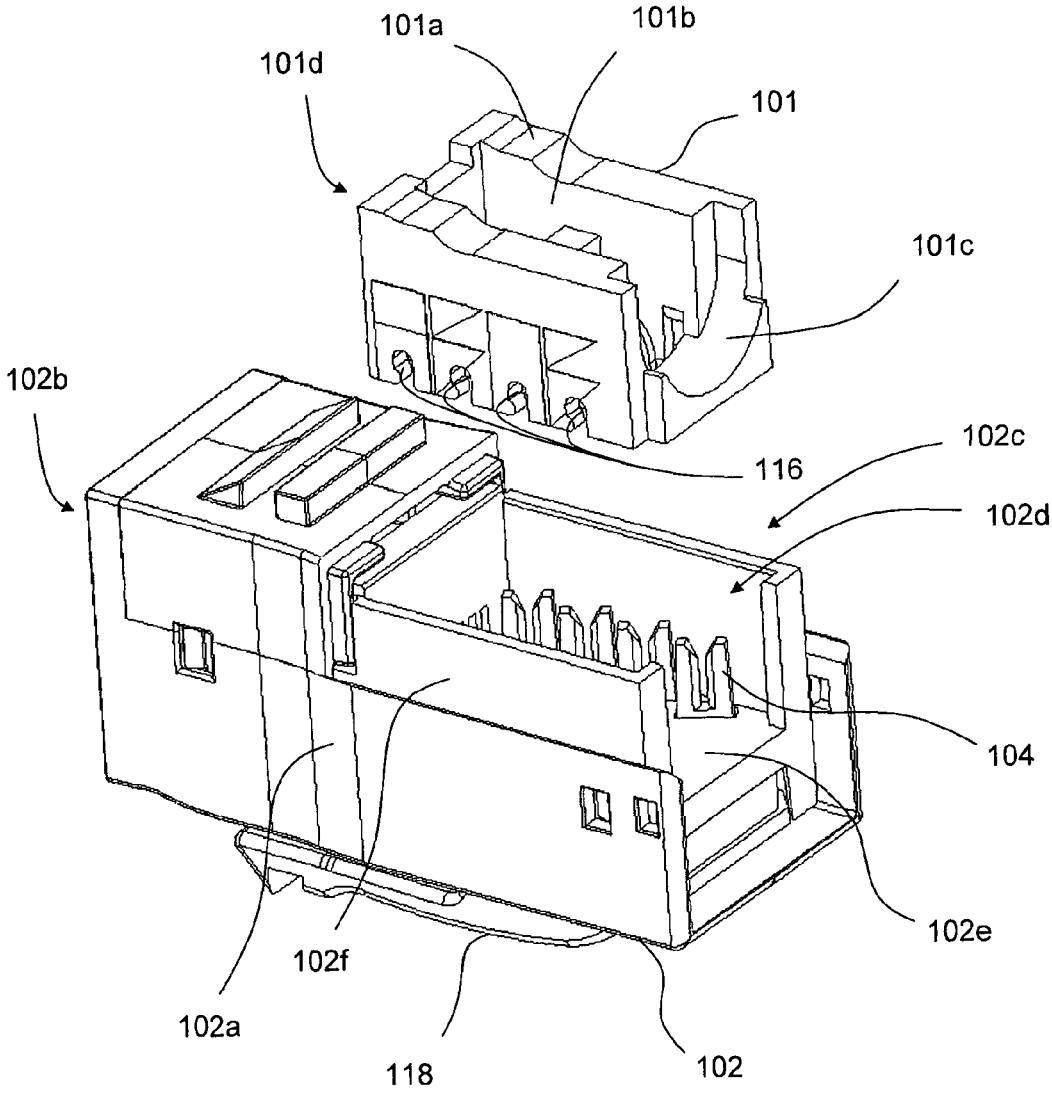
Figure 8:
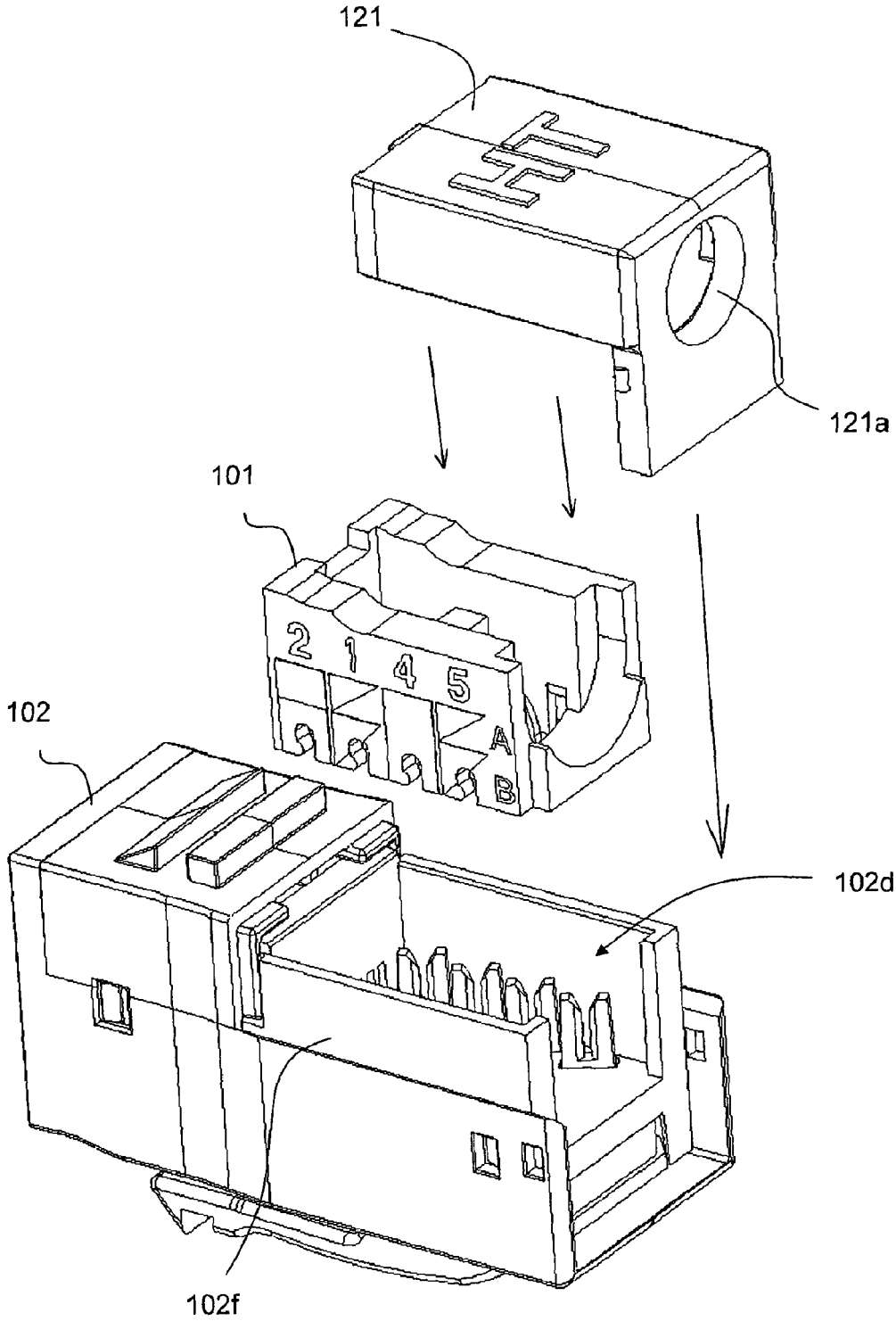
Figure 9:
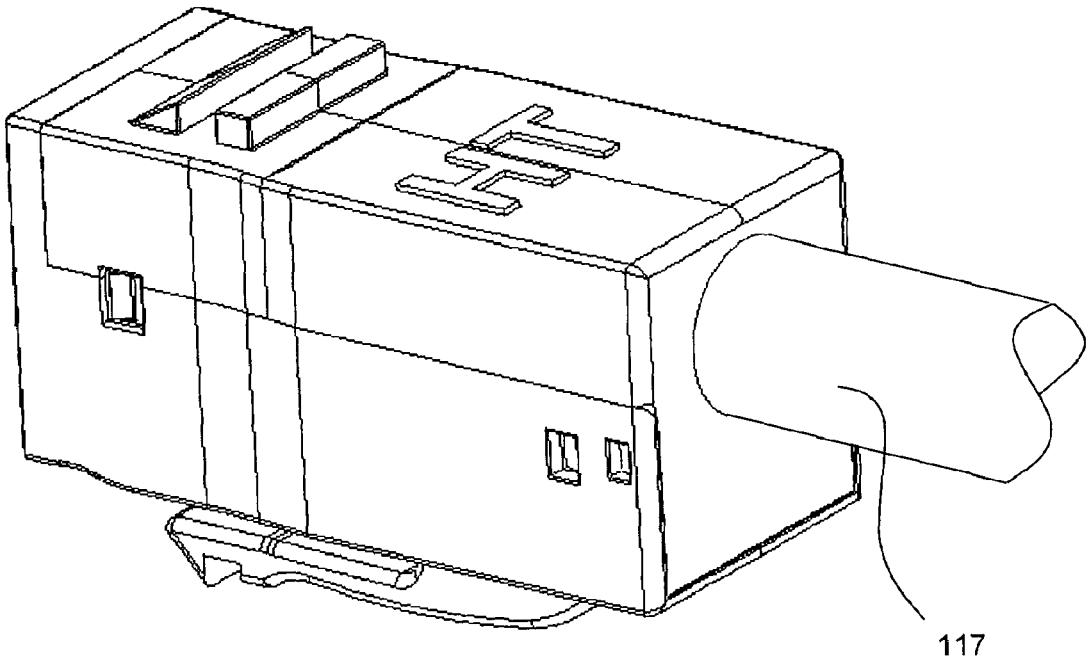
Figure 10:
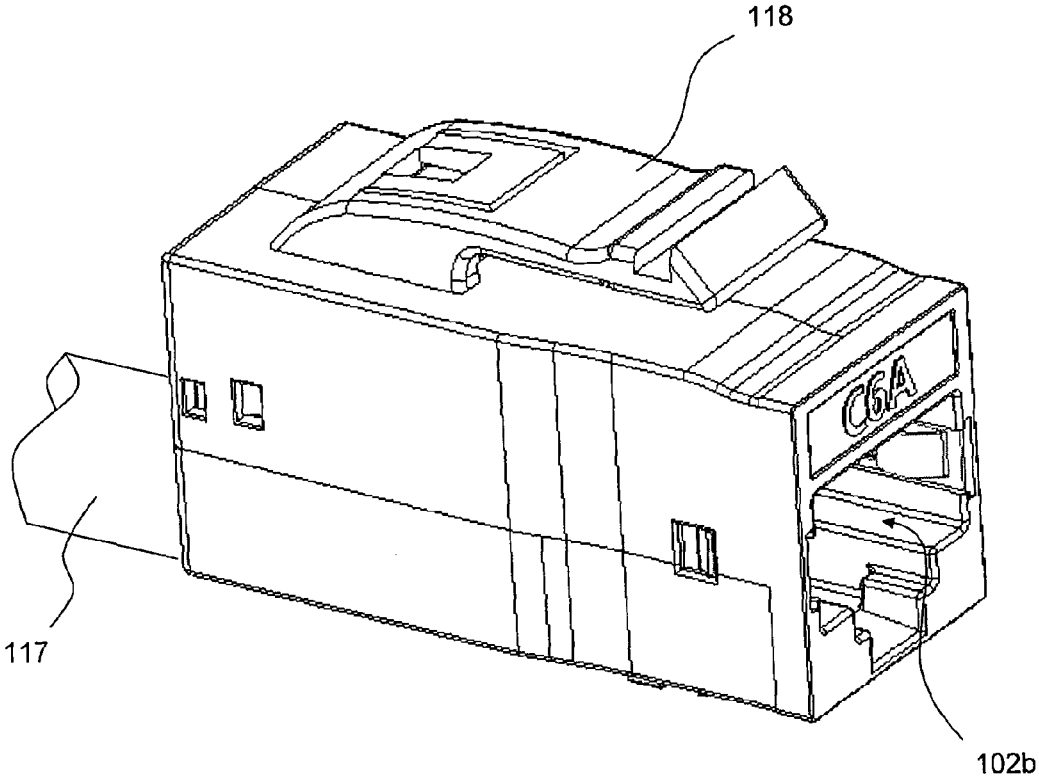

FIGS. 3(*a*), 3(*b*) and 3(*c*) are partial perspective views of the apparatus of FIG. 1, showing extension of the ram;

FIGS. 4(*a*) and (*b*) are overhead views of the first and second cavities at retracted and extended positions of the ram, showing the shape of each cavity;

FIG. 5 is a perspective view of the apparatus of FIG. 1, showing the apparatus fully engaged;

FIG. 6 is a perspective view of the apparatus of FIG. 1, showing retraction of the ram and subsequent removal of the electrical connection assembly;

FIG. 7 is a perspective view of the jack housing and wire arrangement manifold;

FIG. 8 is a perspective view of the wire arrangement manifold cover;

FIG. 9 is a perspective view of the assembled jack housing, wire arrangement manifold and cover; and FIG. 10 is a perspective view of the assembled jack housing, wire arrangement manifold and cover showing the jack socket.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 2:
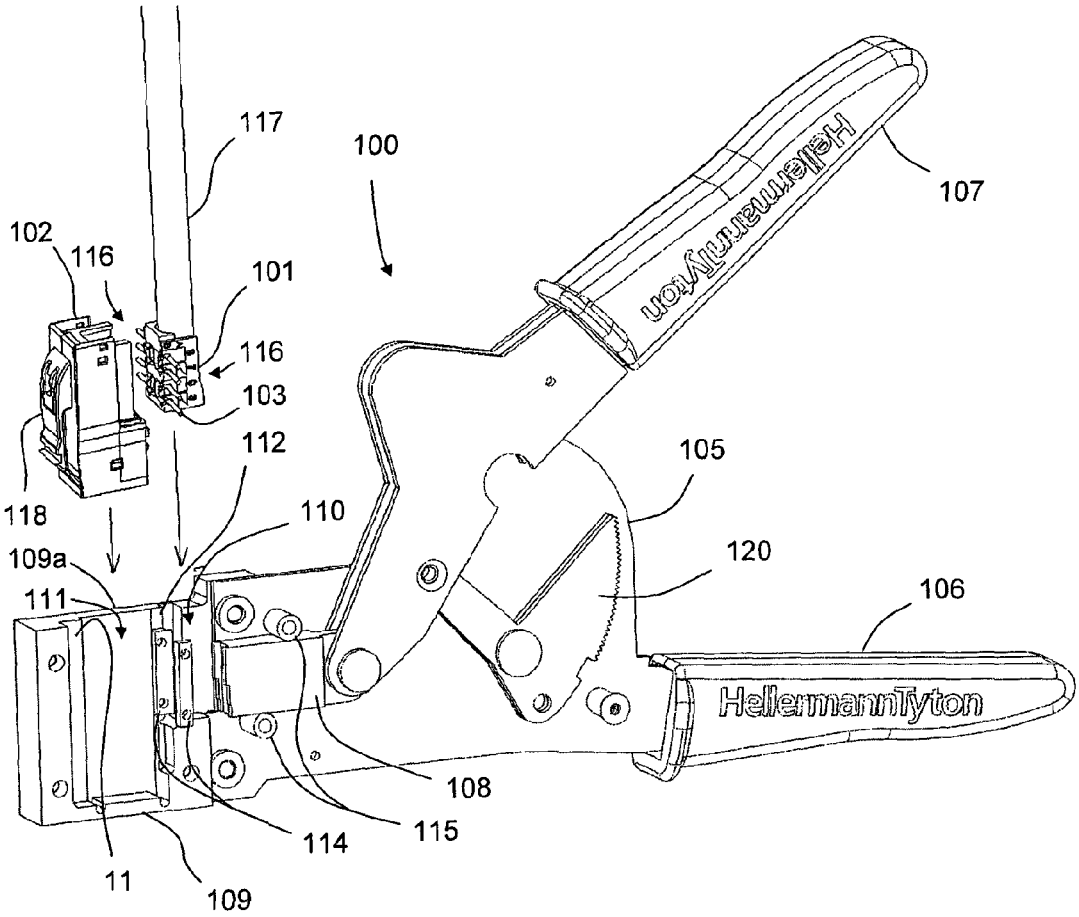
FIG. 2 is an exploded perspective view of the apparatus of FIG. 1.

Referring first to FIGS. 1, 2 and 3, there is shown a hand-held termination tool 100 for effecting automated termination of an wire arrangement manifold 101 into a jack housing 102 for providing electrical connection between wires 103 mounted in the wire arrangement manifold 101 and contact jaws 104 provided in the jack housing 102. The termination tool 100 has a main tool body 105 with a handle 106 fast with the body 105 and a trigger 107 pivotally attached to the body 105 and operably moveable towards the handle 106 in order to effect movement of a ram 108 as described hereinafter. Biasing means such as a spring (not shown) is connected to the trigger 107, which urges the trigger 107 away from the handle 106. Attached to the front portion of the main tool body 105 is a termination housing 109 having a pair of spaced apart cavities 110 and 111 formed therein, each of which extends to the top 109*a* of the termination housing 109, and a passage 112 which extends between the first and second cavities 110, 111 so as to allow movement of an element from the first cavity 110 to the second cavity 111 as described below.

Figure 3A:
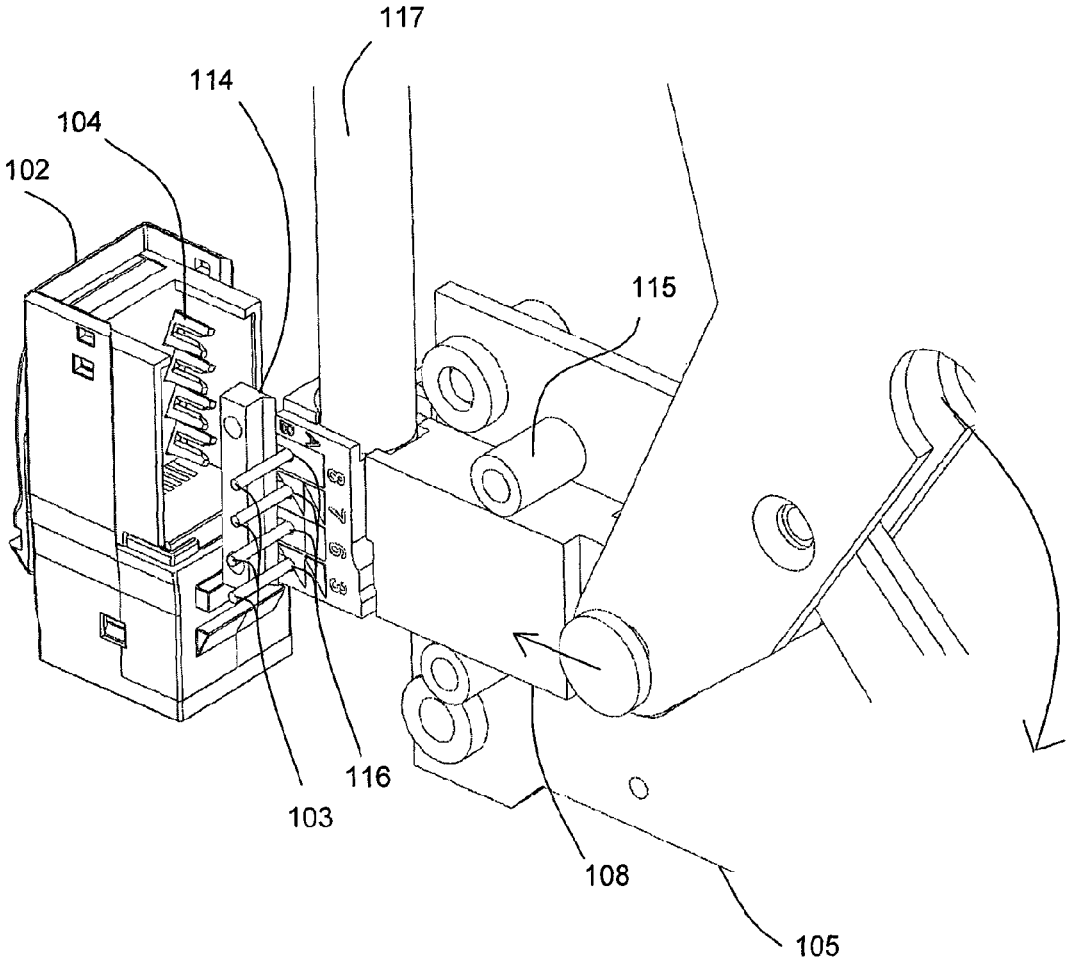
Figure 3B:
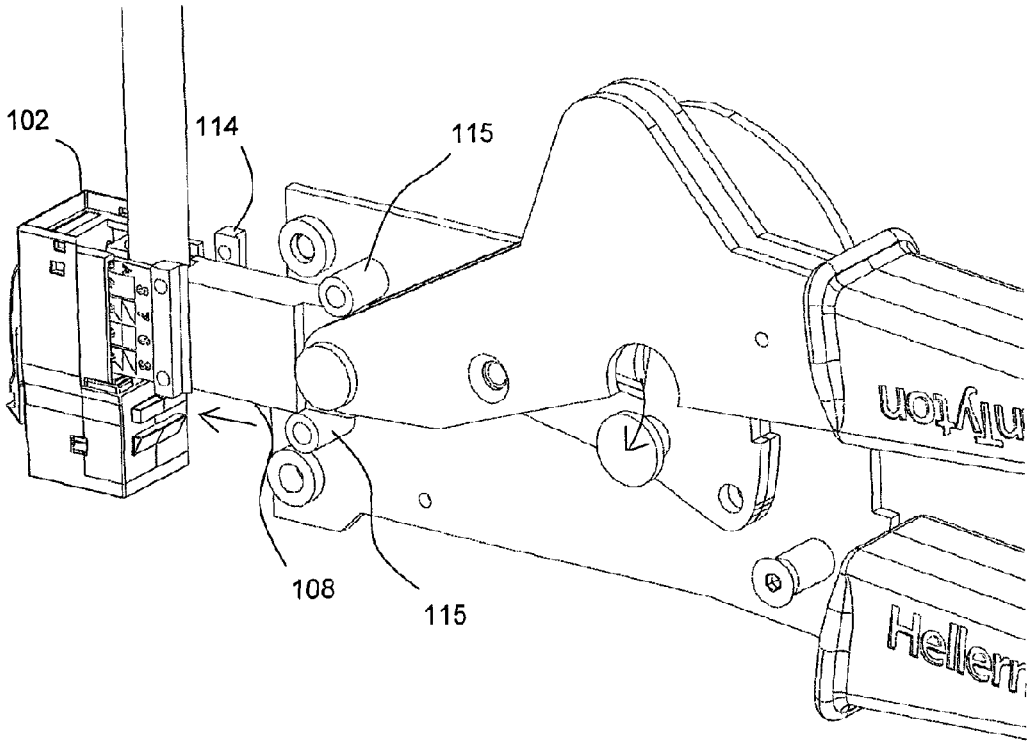
Figure 3C:
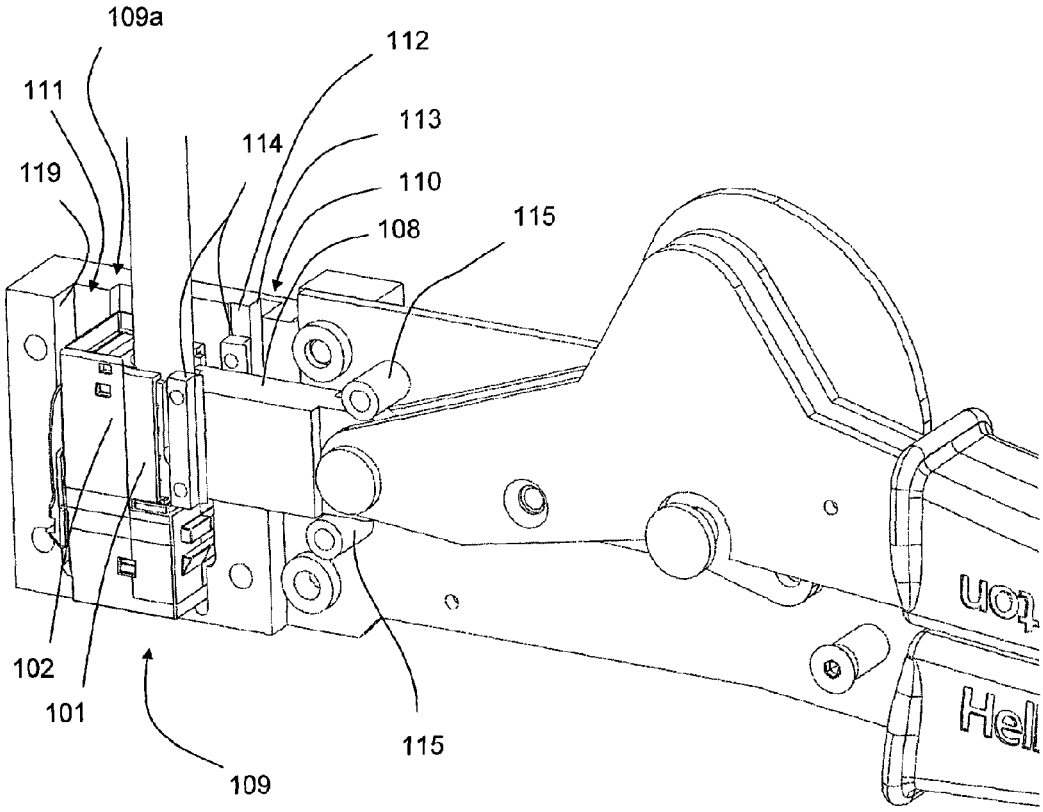

As shown in FIG. 3*c*, the first cavity 110 is generally rectangular in cross section and is sized to enable the wire arrangement manifold 101 to be engaged end on into the cavity from the top side 109*a* of the housing 109 with a close tolerance fit such that the wire arrangement manifold 101 is restrained from lateral movement within the first cavity 110. The first cavity 110 furthermore includes a pair of side wing slots 113, one formed in each side wall of the cavity proximate to the end where it meets the passage 112, each slot 113 extending from the top side 109*a* of the housing 109 substantially the full depth of the first cavity 110.

The second cavity 111 is similarly generally rectangular in cross section but is of a larger cross section and depth compared with the first cavity 110 to accommodate the larger size of the jack housing 102. As with the first cavity 110, the cross section of the second cavity 111 is sized to enable the jack housing 102 to be slid end on into the second cavity 111 from the top side 109*a* of the housing 109, there being a close tolerance fit between the jack housing 102 and the sides of the second cavity 111 so as to prevent lateral movement of the jack housing 102 and hence accurately locate the jack housing 102 laterally therein. The depth of the first and second cavities 110, 111 are furthermore set so that when the wire arrangement manifold 101 and jack housing 102 are fully inserted into their respective cavities, they are accurately longitudinally located relative to each other as well as relative to the passage 112.

The passage 112 which extends between the two cavities 110, 111 is sized laterally to be a close tolerance fit with the wire arrangement manifold 101 so that the wire arrangement manifold 101, once fully inserted into the first cavity 110, can move longitudinally through the passage 112 and into the second cavity 111 and has the same depth as the first cavity 110. A cutting blade 114 is located on each side of the mouth of the passage 112 at the intersection with the first cavity 110 in alignment with the wing slots 113, the blades 114 extending substantially the entire depth of the passage 112 and being laterally spaced apart such that the wire arrangement manifold 101 is a close tolerance fit therebetween. The cutting blades 114 are cutting means for cutting wires.

Although not shown in the illustrated embodiment, the passage 112 may optionally have a rib extending longitudinally along each side proximate to the top, which forms a constriction in the cross section, preventing the wire arrangement manifold 101 from moving vertically as it moves through the passage 112.

Figure 4B:
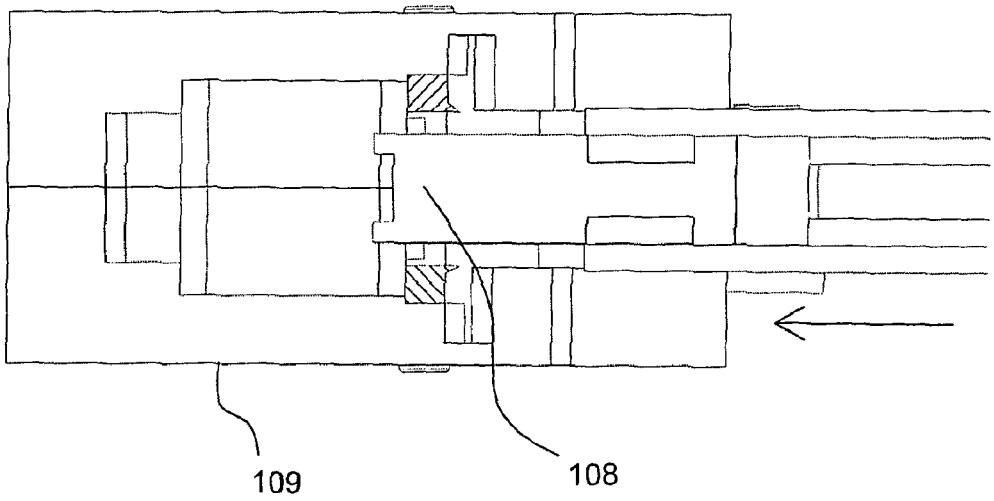

Ram 108 is mounted in the main body 105 in alignment with the passage 112 and is pivotally connected to the end of the trigger 107 so that when the trigger 107 is operated, the ram 108 is moved forwards into the termination housing 109 from a retracted position (shown in FIG. 2) in which it is fully withdrawn into the main body 105 and out of the first cavity 110, and an extended position in which it is moved longitudinally through the first cavity 110 and into the passage 112, projecting into the second cavity 111 as shown in FIG. 4*b*. Guides 115 channel the path of the ram 108 so as to constrain it to move only in the longitudinal direction. The trigger 107 also includes a ratchet mechanism 120, which controls the forward movement of the ram 108 and prevents it from being withdrawn back into its retracted position until it has reached its fully extended position. Such mechanisms are within the practical knowledge of the skilled person and will not, therefore, be described here in greater detail.

The wire arrangement manifold 101, shown in more detail in FIG. 7 comprises a generally rectangular body 101*a* having a through opening 101*b* therein which links to an opening 101*c* in the rear end of the body. A series of notches 116 are formed in the opposing sidewalls extending from the bottom edge thereof, in the illustrated embodiment four equi-spaced notches 116 in each sidewall, in each of which is engageable a single wire of a cable bundle. As shown in FIG. 2, the cable 117 is fed through the rear opening 101*c* and the wires 103 are fed through the opening 101*b* to the bottom of the wire arrangement manifold 101. Each wire 103 is then located in its allotted notch 116, identified by colour coding or the like provided on each side of the body 101*a* in alignment with the notches 116, with the free end of the wire 103 extending laterally from the sides of the wire arrangement manifold 101.

The jack housing 102, also shown in FIG. 7, again comprises a generally rectangular body 102*a* having a jack socket 102*b* in its front face (shown in FIG. 10) with a plurality, in particular eight contacts therein. The top 102*c* of the body 102*a* has a rectangular opening 102*d* formed therein in the bottom 102*e* of which are upstanding a plurality, in particular eight, contact jaws 104, each of which is electrically connected to one of the contacts of the jack socket 102*b*. The jaws 104 are of the type known in the art which are self-terminating with an inserted wire, that is they automatically cut through any insulation on an appropriately sized wire pressed between the jaws so as to make electrical contact with the inner core of the wire, and they are arranged in two spaced apart rows of four jaws corresponding to the pattern of the notches 116 in the wire arrangement manifold 101. The opening 102*d* is bound by opposing sidewalls; a front wall and a rear wall, which has a through opening, formed therein which extends to the top of the opening 102*d*. The opening 102*d* is sized such that the wire arrangement manifold 101 is a press fit therein through the open top of the opening 102*d* with the tail of a cable which extends from the wire arrangement manifold 101 locating in the through opening in the rear wall of the opening 102*d*, each notch 116 in the wire arrangement manifold 101 aligning the wire 103 located therein with one of the jaws 104 so that as the wire arrangement manifold 101 is pressed fully into the opening 102*d*, each wire 103 engages in its associated jaw 104 and makes electrical contact therewith.

A cover 121, as shown in FIGS. 8 and 9, fits over the wire arrangement manifold 101 and secures into the jack housing 102 at the opening 102*d* so as to protect the terminated wires 103 and provide an enclosed casing in which the wire arrangement manifold 101 is held. A recess 102*f* surrounding the opening 102*d* in the jack housing 102 is sized such that the cover 121 is a press fit therein. An opening 121*a* in the cover 121 allows the cable 117 to be fed through.

The tools operates as follows:

The cable 117 is fed through the opening 121*a* of the cover 121 and then through the rear opening 101*c* of the wire arrangement manifold 101. The wires 103 are then inserted through the through opening 101*b* and each wire 103 pressed into one of the notches 116 with the excess wire 103 overhanging the sides of the wire arrangement manifold 101. The jack housing 102 is then inserted into the second cavity 111 with the rectangular opening 102*d* in the top thereof facing the first cavity 110. A mounted hook 118 is provided on the bottom of the jack housing 102 which has a smaller width than the main body 105 and a complementary channel 119 is formed on the side of the second cavity 111 remote from the first cavity 110 such that when the jack housing 102 is inserted into the second cavity 111 in the correct orientation the mounted hook 118 engages in the channel 119, allowing the jack housing 102 to be fully inserted into the second cavity 111, whereas if the jack housing 102 is presented to the termination housing 109 in the wrong orientation, the differing width of the second cavity 111 and guide channel 119 prevents the jack housing 102 from being inserted.

The wire arrangement manifold 101 is then inserted into the first cavity 110 with the bottom 101*d* facing the second cavity 111 so that the notches 116 open towards the second cavity 111. When the wire arrangement manifold 101 is aligned with the first cavity 110 in the correct orientation as shown in FIG. 3*a*, the projecting tails of the wires 103 align with the wings slots 113, providing the extra space to allow the wire arrangement manifold 101 to slide into the first cavity 110. On the other hand, if the wire arrangement manifold 101 is presented to the first cavity 110 in the wrong orientation, the offset configuration of the notches 116 means that the wire tails 103 do not align with the wing slots 113, so that the close tolerance fit between the wire arrangement manifold 101 and the first cavity 110 prevents the wire arrangement manifold 101 from entering the first cavity 110.

Once both the wire arrangement manifold 101 and the jack housing 102 are fully inserted into their respective cavities 110, 111 the trigger 107 is pressed towards the handle 106, moving the ram 108 towards the first cavity 110, engaging the wire arrangement manifold 101 and pressing it towards the passage 112. As the wire arrangement manifold 101 is engaged by the ram 108, the tails of the wires 103 overhanging either side of the wire arrangement manifold 101 are pressed against the cutting blades 114, severing the wires 103 flush with the sides of the wire arrangement manifold 101 and freeing the wire arrangement manifold 101 to move through the passage 112 and into engagement with the aligned rectangular opening 102*d* in the top facing of the jack housing 102 as shown in FIG. 3*b*. Although not shown in the illustrated embodiment the cutting surfaces of the cutting blades 114 are angled with respect to the vertically aligned wires 103 such that they engage with, and subsequently cut, the wires sequentially. The wires 103 opposing each other on either side on the wire arrangement manifold 101 are severed in pairs—the cut of each pair of wires 103 is completed before the leading edge of the cutting blade 114 engages with and then cuts the next pair.

As the ram 108 reaches its fully extended position, the wire arrangement manifold 101 is pressed fully into the jack housing 102 shown in FIG. 3*c*, and the wires 103 mounted in the notches 116 are pressed into engagement with the aligned contact jaws 104 upstanding from the base 102*e* of the opening 102*d* in the jack housing 102, making electrical contacts therewith. The ratchet mechanism 120 prevents the trigger 107 from being released to withdraw the ram 108 back to its retracted position until it has reached its fully extended position, thereby ensuring that the electrical connections are properly made. Once the fully extended position is reached, release of the trigger 107 causes it to move away from the handle 106 under the action of the biasing means, withdrawing the ram 108 from the cavities 110, 111 and releasing the jack housing 102 with wire arrangement manifold 101 fastened thereto to be withdrawn from the second cavity 111. The severed tails of the wires 103 are free to drop out of the wing slots 113 and the tool is ready for the next termination operation. Finally, on removal of the terminated wire arrangement manifold 101 and jack housing 102 from the termination housing 109, the cover 121 is manually pressed into the recess 102*f* in the jack housing 102 so as to enclose the terminated wires 103.

Thus, the hand-held tool can be used to achieve a terminated connector assembly by the action of one continuous motion; trimming the connector wires and terminating connector halves, without the need to stop to reposition components.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A termination tool for terminating multiple wires to a two part electrical connector assembly composed of a wire arrangement manifold and a jack housing, the termination tool comprising a main tool body having a termination housing provided thereon including a first cavity, a second cavity and a passage extending between the first and second cavities, the first cavity having an open side to receive and being shaped to removably retain the wire arrangement manifold, the second cavity having an open side to receive and being shaped to removably retain the jack housing, and the passage being sized to allow, in use, the wire arrangement manifold to pass therethrough from the first cavity to the second cavity and having cutting means for cutting wires provided on opposing sides of its end proximate to the first cavity, the termination tool further comprising a ram aligned with the passage and actuatable by actuating means to move between a retracted position in which the ram is withdrawn from the first cavity and a second position in which the ram extends through the passage so as, in use, to press the wire arrangement manifold from the first cavity, through the passage and into engagement with the jack housing located in the second cavity, the cutting means severing any overhanging wire tails from the sides of the wire arrangement manifold as it enters the passage.

2. The termination tool according to claim 1, wherein the first cavity is of complementary shape to and a close tolerance fit with the wire arrangement manifold such that, in use, the wire arrangement manifold is constrained against lateral movement in the first cavity.

3. The termination tool according to claim 2, wherein the second cavity is of complementary shape to and a close tolerance fit with the jack housing such that, in use, the jack housing is constrained against lateral movement in the second cavity.

4. The termination tool according to claim 1, wherein the first cavity includes a groove in each side surface thereof adjacent the cutting means at a mouth of the passage in which, in use, tails of wires inserted into the wire arrangement manifold are received so as to align them for trimming by the cutting means upon operation of the tool.

5. The termination tool according to claim 1, wherein the cutting means comprises a pair of blades, one on either side of a mouth of the passage.

6. The termination tool according to claim 1, wherein the position of the cutting means is set in relation to a thickness and spacing of wires in the wire arrangement manifold, such that, in use, a leading edge of the cutting means engages with, and subsequently severs, the wire tails sequentially.

7. The termination tool according to claim 6, wherein said cutting means are offset relative to each other in a direction of movement of the wire arrangement manifold.

8. The termination tool according to claim 6, wherein a cutting edge of each cutting means is inclined to the direction of movement of the wire arrangement manifold.

9. The termination tool according to claim 8, wherein the angle of inclination of each cutting means is set such that, in use, the wire tails on each side of the wire arrangement manifold are severed sequentially, the severing of each wire tail being completed before the next wire tail is engaged by the cutting means.

10. The termination tool according to claim 1, wherein a width of the passage is equal in width to the first cavity.

11. The termination tool according to claim 10, wherein the passage includes a longitudinally extending rib on the top of each side which reduces the width of the passage at the top and thereby prevents the wire arrangement manifold from being removed from the passage during operation of the tool.

12. The termination tool according to claim 1, wherein the second cavity includes one of a projection and a recess in a side thereof.

13. The termination tool according to claim 12 wherein, a side opposite the passage and the jack housing includes a complementary other of a projection and a recess which aligns with the one of the projection and the recess when the jack housing is correctly oriented with respect to the second housing.

14. The termination tool according to claim 1, wherein the jack housing includes a tab, which engages in a slot, which extends from the open side of the second cavity.

15. The termination tool according to claim 1, wherein the open sides of the first and second cavities are on the same side of the tool.

16. The termination tool according to claim 1, wherein a depth of the first cavity is such that when the wire arrangement manifold is fully inserted therein, it aligns with the passage.

17. The termination tool according to claim 16, wherein the depth of the second cavity is such that when the jack housing is fully inserted therein, an opening in the jack housing in which the wire arrangement manifold engages for effecting termination is aligned with and facing the passage.

18. The termination tool according to claim 1, wherein the tool is hand operated.

19. The termination tool according to claim 1, wherein a trigger is connected to the ram so as to effect longitudinal movement of the ram from its retracted position to its extended position.

20. The termination tool according to claim 19, wherein a ratchet mechanism is integrated with the trigger mechanism and which operates to prevent retraction of the ram once operative movement has commenced, until the ram has reached its fully extended position.

21. The termination tool according to claim 19, wherein the trigger is spring-loaded to effect return of the ram to its retracted position once the termination stroke has been completed.

22. A wire arrangement manifold for use with a termination tool according to claim 1, comprising a body having an end surface with an opening therein through which, in use, a cable formed of a plurality of separate wires is insertable, a front face having a plurality of notches formed therein proximate to at least one side of the wire arrangement manifold, each notch sized to retain one of the wires of the cable therein, and a passage extending from the opening in the end surface to the front face for channelling the wires to the notches.

23. The wire arrangement manifold according to claim 22, wherein the notches in the front face are arranged in two rows, one extending along each side of the body, with the notches being equi-spaced along the body.

24. The wire arrangement manifold according to claim 22, wherein the end housing has eight notches arranged in two rows of four.

25. The wire arrangement manifold according to claim 22, wherein the body is rectangular in shape, at least when viewed in the direction of the front face.

26. The wire arrangement manifold according to claim 22, wherein the end face is open to the back of the end housing, the passage taking the form of a through opening which extends from the back to the front face of the body.

27. A jack housing for matingly engaging with a wire arrangement manifold of claim 22, the jack housing comprising a body having a socket formed in a front end therein containing a plurality of contacts, an opening in a top side of the body and a plurality of termination jaws upstanding from the bottom of the opening, each termination jaw being electrically connected to an associated one of the contacts, the opening being of complementary size and shape to the wire arrangement manifold such that, in use, the wire arrangement manifold is insertable into the opening from the top thereof such that each wire located in one of the notches in the wire arrangement manifold engages between one of termination jaws, effecting electrical contact therewith.

28. The jack housing according to claim 27, wherein the back wall of the opening in the jack housing has a slot formed therein extending from the top edge, the cable extending from the wire arrangement manifold, in use, being received in the slot as the wire arrangement manifold engages in the opening.

29. The jack housing according to claim 27, wherein the bottom of the body has a guide tab thereon of narrower width than the main body, which, in use, aligns with and engages in a complementary shaped recess formed in the second cavity when the jack housing is correctly oriented with respect to the second cavity and prevents entry of the jack housing into the second cavity in the wrong orientation.

30. The jack housing according to claim 29 wherein the guide tab is formed as a mounted hook for latching the jack housing in place in a patch panel, wall mounting or the like.

31. The jack housing according to claim 27, wherein the opening includes eight termination jaws arranged in two rows of four to complement the arrangement of the notches in the wire arrangement manifold, each jaw being composed of a pair of metal prongs with a space between them which narrows towards the base of the opening such that as a wire is pressed therebetween, the jaws progressively cut through the insulation on the wire and make electrical contact with the core of the wire.

* * * * *